US008016373B2

(12) United States Patent
Weber et al.

(10) Patent No.: US 8,016,373 B2
(45) Date of Patent: Sep. 13, 2011

(54) DRAWER

(75) Inventors: Konrad Weber, Ebsdorfergrund (DE); Thorsten Hötger, Enger (DE)

(73) Assignee: Paul Hettich GmbH & Co KG, Kirchlengern (DE)

( * ) Notice: Subject to any disclaimer, the term of this patent is extended or adjusted under 35 U.S.C. 154(b) by 765 days.

(21) Appl. No.: 12/094,164

(22) PCT Filed: Oct. 31, 2006

(86) PCT No.: PCT/EP2006/067980

§ 371 (c)(1), (2), (4) Date: May 19, 2008

(87) PCT Pub. No.: WO2007/060082

PCT Pub. Date: May 31, 2007

(65) Prior Publication Data

US 2008/0224584 A1 Sep. 18, 2008

(30) Foreign Application Priority Data

Nov. 26, 2005 (DE) ..... 20 2005 018 514 U

(51) Int. Cl.
*A47B 95/00* (2006.01)

(52) U.S. Cl. ..... 312/331; 312/334.1; 312/330.1

(58) Field of Classification Search ..... 312/331, 312/332, 334.1, 334.7–334.9, 330.1, 402–404, 312/408, 309–311

See application file for complete search history.

(56) References Cited

U.S. PATENT DOCUMENTS

| | | | | | |
|---|---|---|---|---|---|
| 1,902,795 | A * | 3/1933 | Wolters | 312/331 |
| 3,093,429 | A * | 6/1963 | Curtis et al. | 312/331 |
| 3,748,005 | A * | 7/1973 | Chovanec et al. | 312/109 |
| 4,436,989 | A * | 3/1984 | Schuldt | 235/22 |
| 6,039,421 | A * | 3/2000 | Fulterer | 312/333 |
| 7,185,959 | B2 * | 3/2007 | Mueller et al. | 312/331 |
| 7,527,342 | B2 * | 5/2009 | Lemm | 312/331 |

FOREIGN PATENT DOCUMENTS

| | | | |
|---|---|---|---|
| DE | 102 27 881 | A1 | 1/2004 |
| DE | 202004007109 | U | 5/2005 |
| DE | 10 2004 002 823 | A1 | 8/2005 |
| EP | 0512615 | A1 | 11/1992 |
| EP | 1716782 | A | 2/2006 |
| JP | 61045480 | A * | 3/1986 |

* cited by examiner

*Primary Examiner* — Hanh V Tran
(74) *Attorney, Agent, or Firm* — Barnes & Thornburg LLP

(57) ABSTRACT

A drawer can be displaced relative to a basic furniture structure, via a pull-out guide. The drawer has, on the opposite sides, in each case at least one gearwheel which meshes with a rack, secured on the basic furniture structure, and is coupled to a gearwheel on the opposite side. The racks can be extended in length in each case via a pivotable lever, in order to ensure that the drawer is also guided by the gearwheels in the pulled-out position. A pivotable lever can be disengaged from the meshing gearwheel in order for it to be possible to correct skewed positioning of the drawer. This ensures that the drawer is guided by the gearwheels over its entire displacement path.

10 Claims, 8 Drawing Sheets

DRAWER

BACKGROUND AND SUMMARY OF INVENTION

This application is a National Phase Application based upon and claiming the benefit of priority to PCT/EP2006/067980, filed on Oct. 31, 2006, which is based upon and claiming the benefit of priority to German Application DE 20 2005 018514.0, filed on Nov. 26, 2005, the contents of which are incorporated herein by reference.

The present invention relates to a drawer which can be displaced relative to a basic furniture structure, via a pull-out guide, from a position within the basic furniture structure into a pulled-out position in front of the basic furniture structure. The drawer has, on the opposite sides, in each case at least one gearwheel which meshes with a rack, secured on the basic furniture structure, and is coupled to a gearwheel on the opposite side. It is possible for the racks to be extended in length in each case via a pivotable lever, in order to ensure that the drawer is also guided by the gearwheels in the pulled-out position.

EP 512 615 discloses a pull-out guide for a drawer in which racks are provided on opposite sides in order to stabilize the running movement. These racks engage gearwheels which are coupled to one another via a shaft. In order to stabilize the running movement in a pulled-out position, the racks can be extended in length by a lever which, with the drawer in a pulled-out position in front of the basic furniture structure, is pivoted in order that the racks can be extended in length and can engage with gearwheels. It may be the case, however, that during installation or for other reasons, the gearwheels are offset in relation to one another and skewed positioning of the drawer thus has to be corrected. In the case of this design, complicated installation work then has to be carried out for this purpose.

EP 11 41 640 discloses a pull-out guide for a refrigerator which racks are provided on opposite longitudinal sides, and these racks mesh with gearwheels of the drawer in order to synchronize the movement of the drawer. This drawer, however, cannot be moved all the way into a position in front of the basic furniture structure. If skewed positioning of the drawer is present, correction can take place since, in the pushed-in position, the rack and the gearwheels are disengaged. In which case, it is not possible for jamming to take place as a result of skewed positioning of the drawer in the retracted position. However it is then also the case that the drawer is no longer synchronized by the gearwheels in the region of the retracted position.

The object of the present invention is thus to provide a drawer which has good running properties and can be displaced in front of the basic furniture structure, and if required, allows skewed positioning to be corrected.

According to the invention, when the drawer is displaced into a pulled-out position in front of the basic furniture structure, it is possible for the rack to be extended in length via a pivotable lever in order also to ensure guidance in the pulled-out position, and for the disengagement of the pivotable lever and the meshing gearwheel to allow correct skewed positioning of the drawer if required. This ensures that the drawer is guided by the gearwheels over its entire displacement path, and good running properties are thus provided. But it is also possible to correct skewed positioning in the pulled-out position, without any complicated dismantling of components being necessary. This is because the pivotable lever can easily be disengaged from the gearwheel to allow corresponding correction.

According to a configuration of the invention, the lever, in a correction position, can be raised up from the gear wheel. The raising operation here can take place manually or automatically.

In order for the drawer also to be guided to good effect in the region of the lever, the lever is guided between the gearwheel and a sliding element it is possible for the sliding element, in a correction position, to be moved away from the lever. The sliding element may be a lever element which can be pivoted manually away from the lever in order for the lever to be released if required, so that it can be disengaged from the gearwheel.

According to a further configuration of the invention, means are provided for automatically raising the lever. It is then possible, when the drawer is moved into a correction position, for the automatic disengagement between the gearwheel and lever. In which case, all that is still required is for the drawer to be properly placed in position. For this purpose, it is possible to provide, on the lever, a respective driver, on which the means for raising the lever act in order for the lever to be raised from the gearwheel. The means for raising the lever here can be actuated automatically by virtue of the drawer being moved into a correction position.

The correction position is preferably the position in which the drawer has been pulled out to the full extent. This position usually is not reached in normal usage since the contents of the drawer are accessible prior to this position being reached.

In order that the lever for extending the length of the rack cannot be seen from the outside, it is designed such that it can be pivoted downward into the basic furniture structure when the meshing gearwheel is moved into the basic furniture structure.

The invention will be explained in more detail herein below by way of two exemplary embodiments and with reference to the accompanying drawings in which

DETAILED DESCRIPTION OF THE EMBODIMENTS

Figure 1:
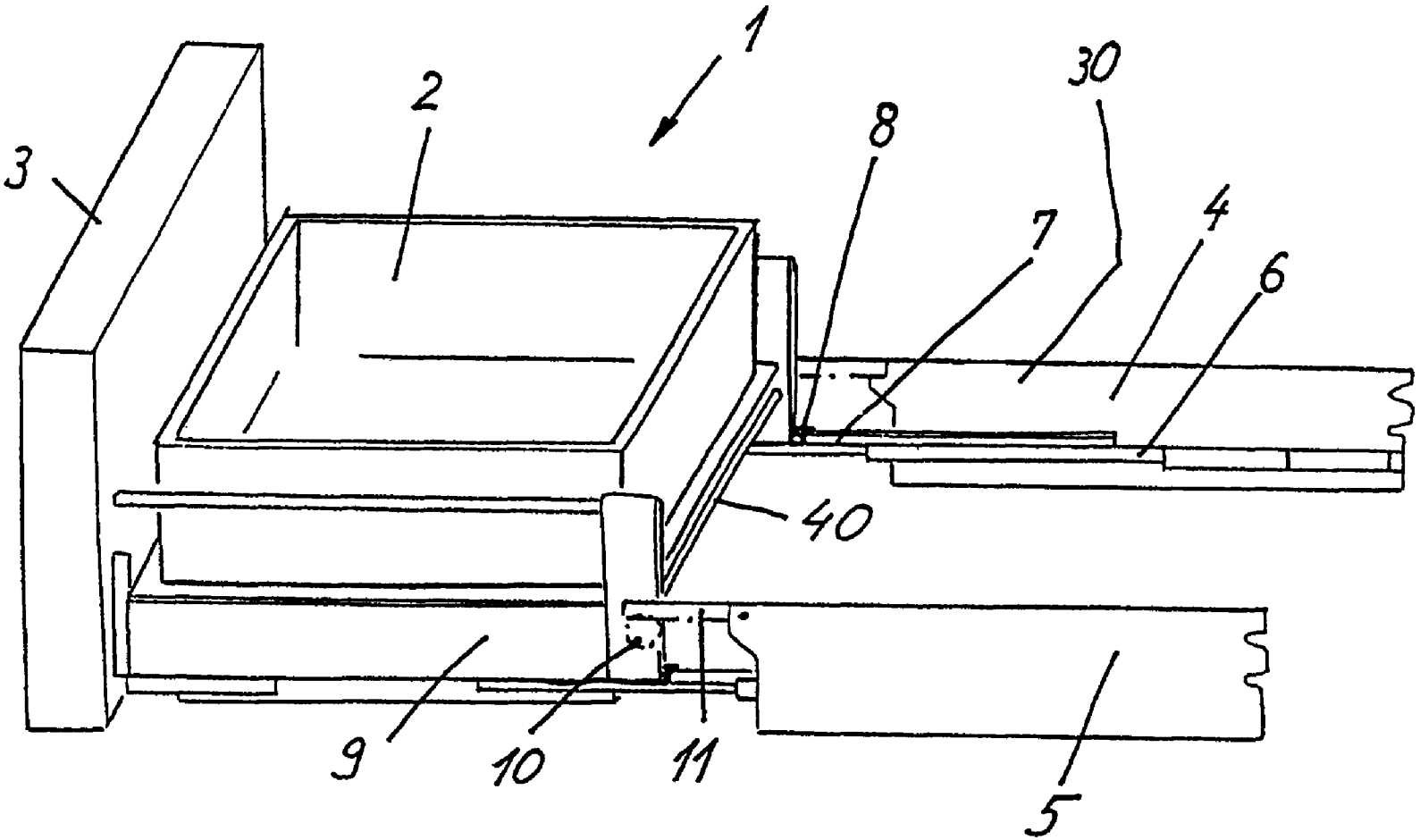
FIG. 1 shows a perspective view of one exemplary embodiment of a drawer according to the invention.

A drawer 1 comprises a push-in enclosure 2 which can be displaced relative to a basic furniture structure as shown in FIG. 1. For this purpose, the push-in enclosure 2 is guided on a lefthand side part 4 and a right-hand side part 5, which are of mirror-inverted design. Provided on the side parts 4 and 5 is a respective pull-out guide having a stationary rail 6, which is fixed on the furniture a pull-out rail 8, which is fixed on the drawer 1, and a central rail 7. The central nail 7 is moved at half the speed of the pullout rail 8 and allows extended pullout action, in which case the drawer 2 is then arranged in front of the basic furniture structure.

Mounted in a rotatable manner on a side part 9 of the drawer 1 is a gearwheel 10, which is connected to a gearwheel 10 on the opposite side via a shaft 40. The gearwheels 10 each engage in a rack 30 on the side part 4 or 5 and ensure synchronization of the running movements of the two sides of the drawer 1.

In order that the drawer 1 is also guided in the region of the pulled-out position, in which the gearwheels 10 have left the side parts 4 and 5, pivotable levers 11 are provided in order to extend the length of the rack 30. These levers are pivoted upward into a horizontal position when they engage with the gearwheels 10. It is possible, in the region of the pivotable levers 11, to eliminate the engagement between the gearwheel 10 and lever 11 to correct skewed positioning of the drawer 1. This is because it may be the case during installation, or for other reasons, that the drawer 1 is skewed relative to a front side of the basic furniture structure and a front panel 3 does not fit precisely into the basic furniture structure. The gearwheel 10 then has to be displaced to the desired extent relative to the rack 30 and/or the lever 11 in order for this skewed positioning to be corrected.

Figure 2:
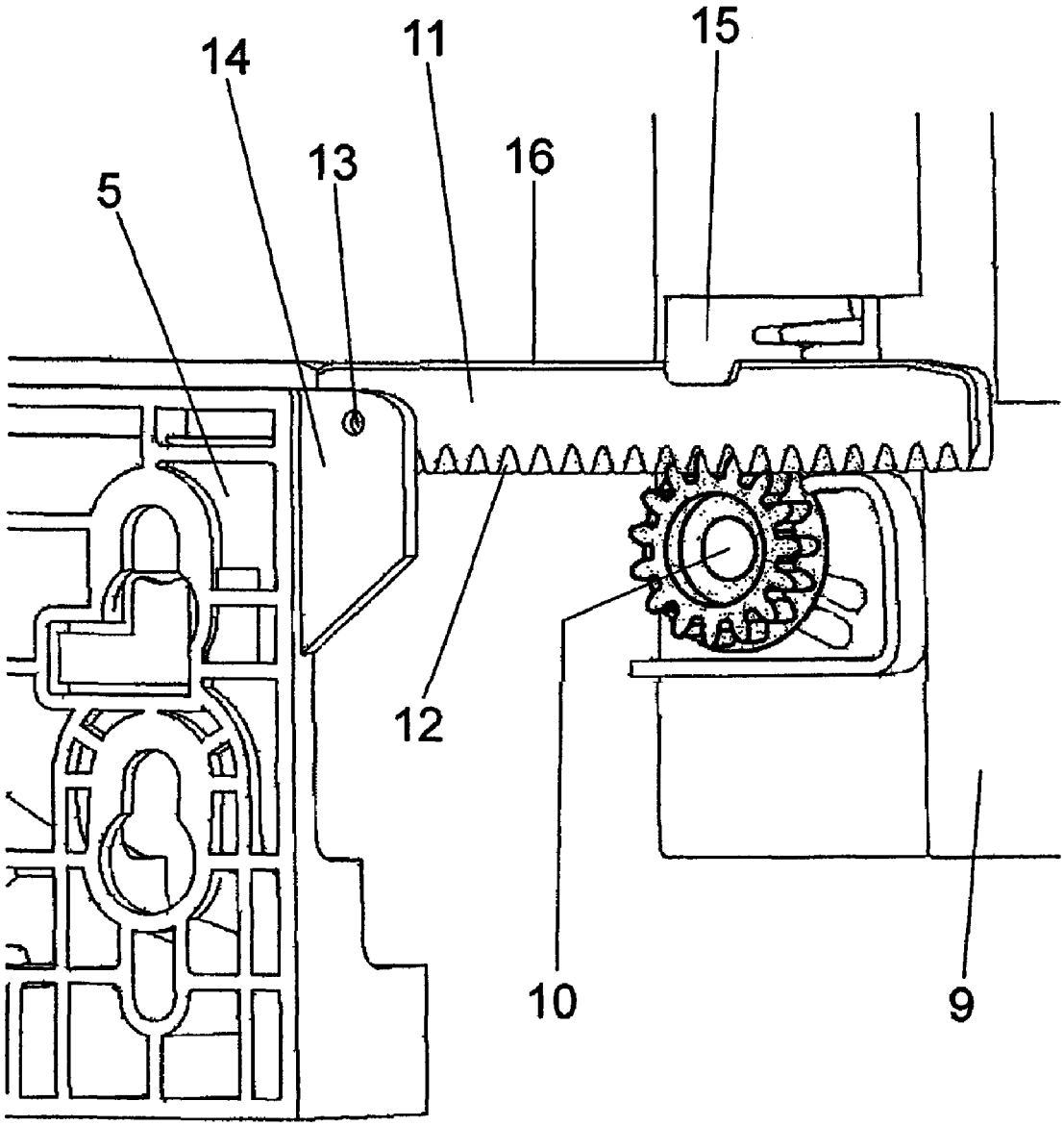
FIG. 2 shows a view, in detail form, of the drawer from FIG. 1.

As can be seen in FIG. 2, the gearwheel 10 meshes with a rack 12 formed on the underside of the lever 11. The lever 11 is mounted on the side part 5 such that it can be pivoted about an axis 13. The side part 5 has arranged on it here, as bearing location, a web-like extension arm 14, in which the axis of rotation 13 is provided. If the gearwheel 10 is moved into the basic furniture structure between the side parts 4 and 5, the lever 11 can thus pivot downwards as a result of gravitation force and is concealed in the basic furniture structure. It is only when the gearwheel 10 is pulled out of the basic furniture structure to the extent where it comes into contact with the lever 11 that the latter, in the course of further outward movement, pivots into the horizontal position shown.

In order to prevent the gearwheel 10 from disengaging from the rack 12 of the lever 11, a sliding element 15 is provided as an abutment above the lever 11. This sliding element 15 is secured on the side part 9 and thus is always being arranged at the same distance above the gearwheel 10. Rather than it being possible for the lever 11 to be accidently raised up further from the gearwheel 10, the lever 11 is thus guided on the sliding element 15 via a sliding surface 16 of the lever 11.

Figure 3:
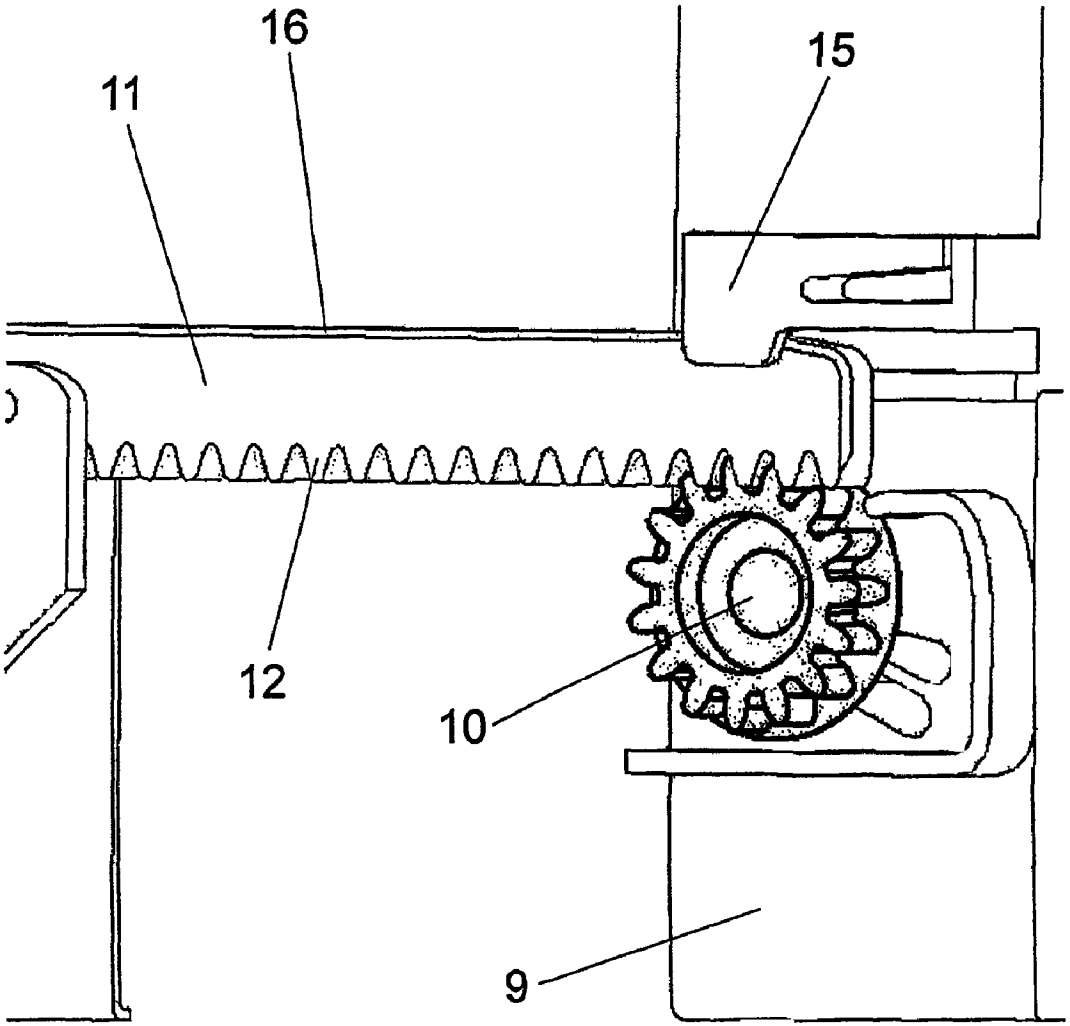
FIG. 3 shows a view, in detail form, of the drawer of FIG. 1 with the drawer pulled out to the full extent.

In FIG. 3, the drawer has reached the position in which it as been pulled out to the full extent, and in which the gearwheel 10 has arrived at the end of the lever 11. Also in this position, there is guidance between the gearwheel 10 and rack 12 of the lever 11. It is possible, however, to correct the positioning between the gearwheel 10 and rack 12 in order to compensate for skewed positioning of the drawer.

Figure 4:
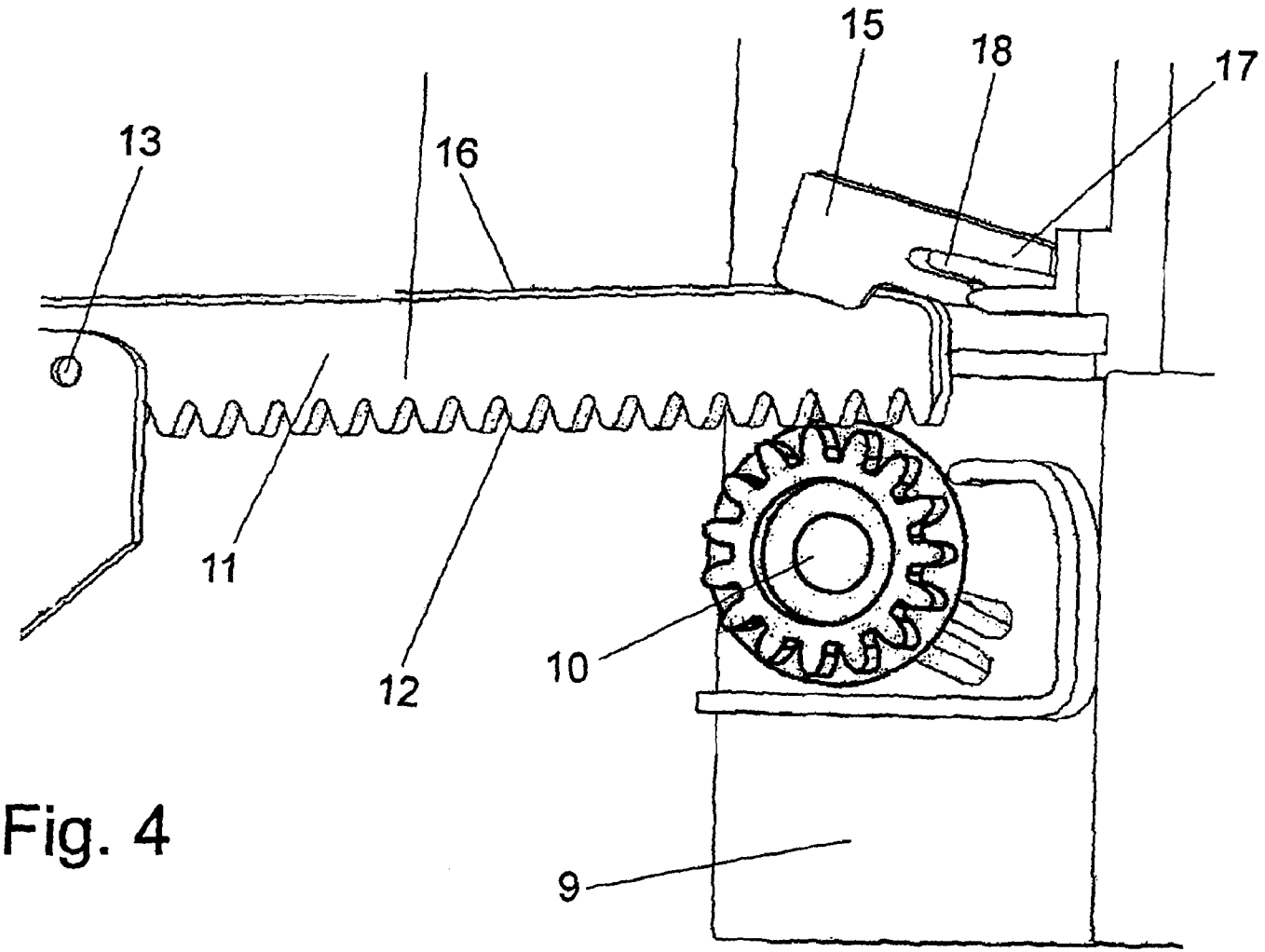
FIG. 4 shows a view, in detail form, of the drawer of FIG. 1 in the correction position.

For this purpose, as is shown in FIG. 4, the sliding element 15 is pivoted by an actuating lever 17 being pushed manually downward. A sliding surface on the sliding element 15 thus disengages from the sliding surface 16 on the lever 11, in which case the latter can be pivoted upward to a slight extent, the toothing of the gearwheel 10 and the toothing of the rack 12 disengaging. In this position, the gearwheel 10 can be moved relative to the rack 12 by one or more teeth in order for it to be possible to execute a correcting movement. The rack of the lever 11 then engages with the gearwheel 10 again and the sliding element 15 is pushed against the sliding surface 16 again in order to prevent further displacement.

FIGS. 5-8 show a modified embodiment of the invention, the same components being provided with the same designations. This exemplary embodiment provides means in order, in a position in which the drawer has been pulled out to the full extent, for the lever 11 to be raised up automatically (with positive guidance) from the gearwheel 10. Thus, it is possible to compensate for skewed positioning of the drawer 1 without any further installation steps.

Figure 5:
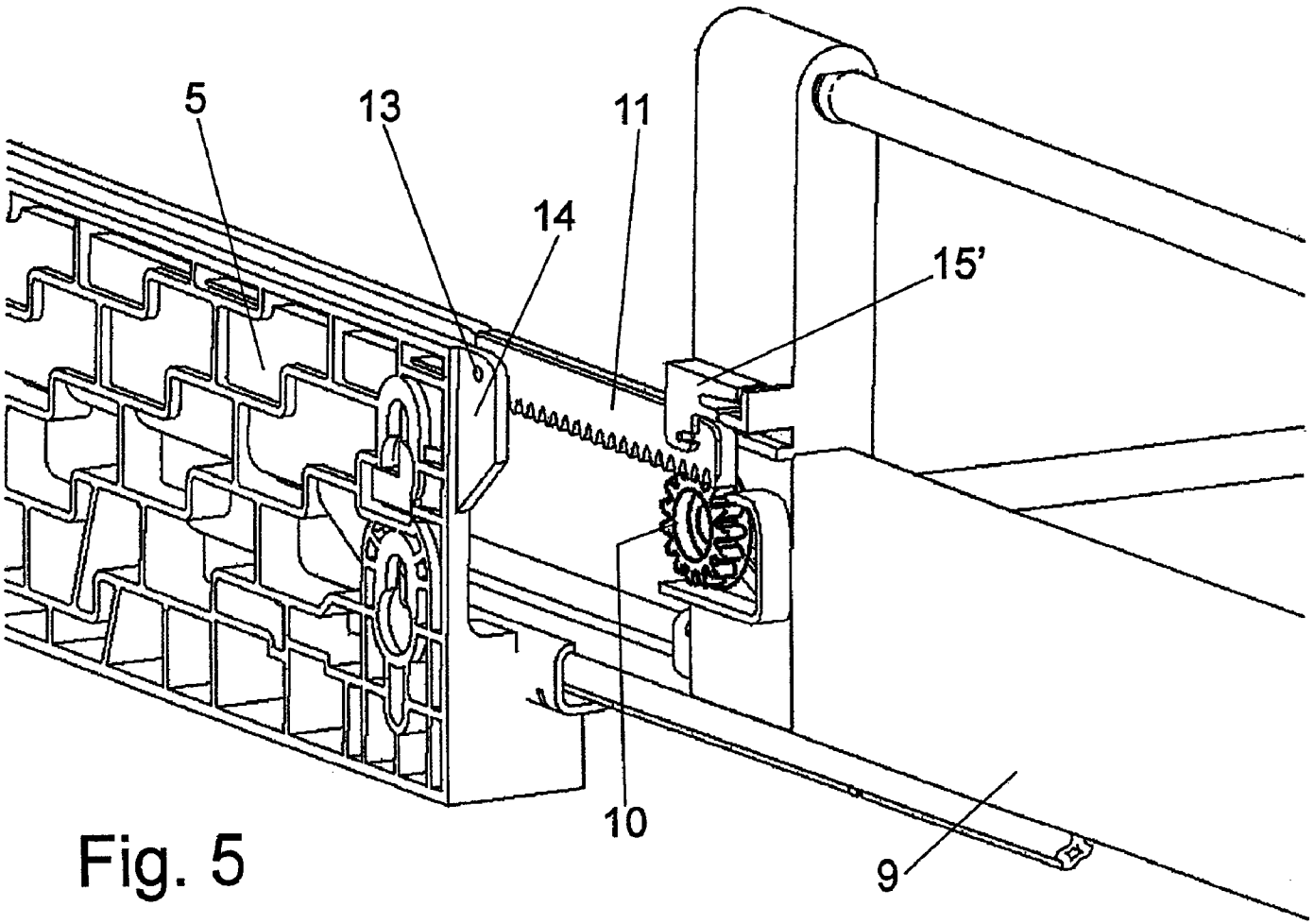
FIG. 5 shows a perspective view, in detail form, of a drawer according to a second exemplary embodiment.
Figure 6:
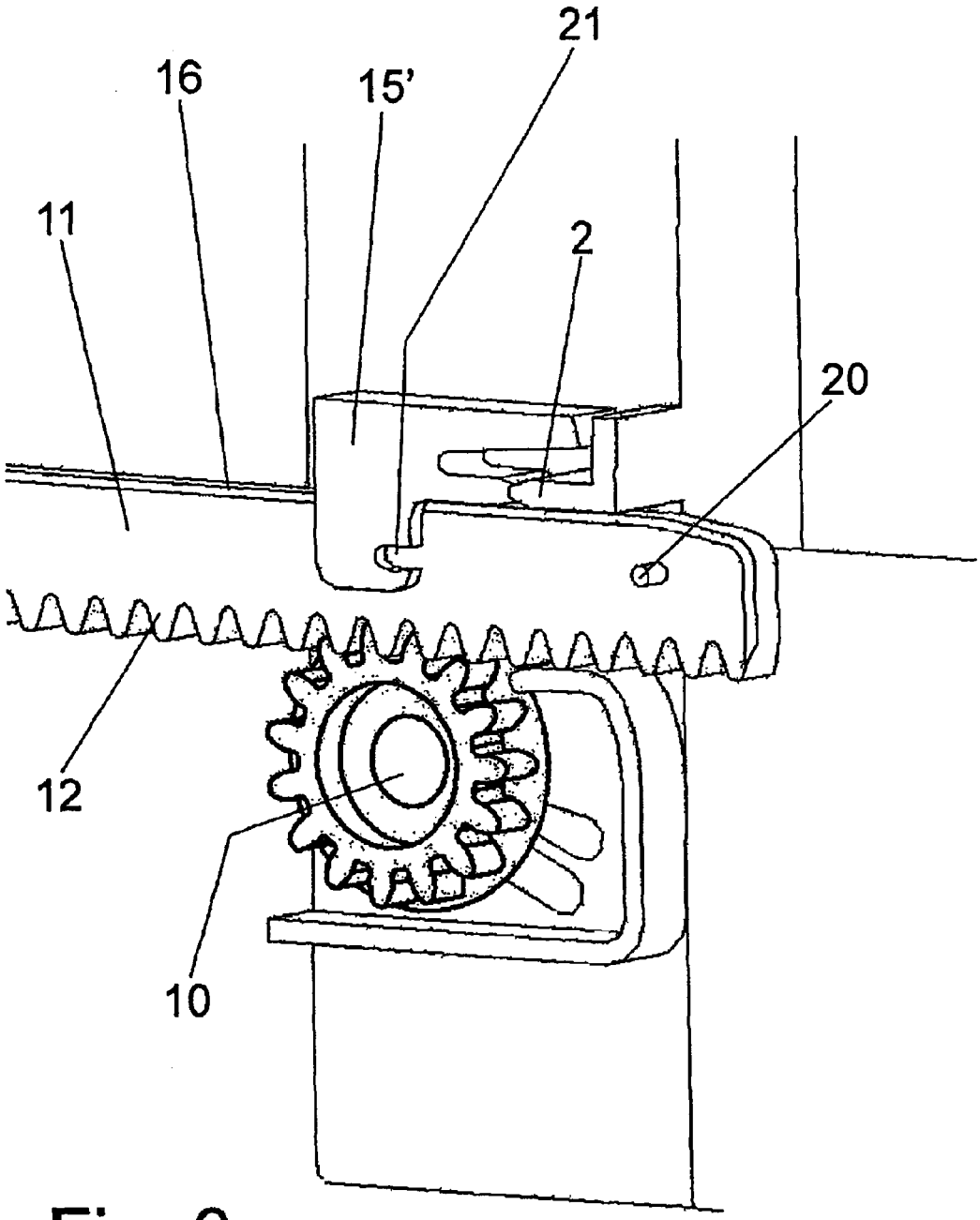
FIG. 6 shows an enlarged view, in detail form, of the drawer of FIG. 5 prior to the correction position being reached.

As is shown in FIGS. 5 and 6, the gearwheel 10, once again, moves along the lever 11, which, in a position in which the drawer has been pulled out in front of the basic furniture structure, is displaceable, and, for guidance purposes, the lever 11 has been pivoted into the horizontal position. Upward movement of the lever 11 is avoided here by a sliding surface 16 butting against a sliding element 15', or a certain amount of play provides for at least a raising action of the lever 11 being avoided. A driver 20 in the form of a peg is provided on the lever 11. The peg 20 interacts with a holder or slot 21 in the sliding element 15' in order to raise the lever 11 in an end position of the drawer.

Figure 7:
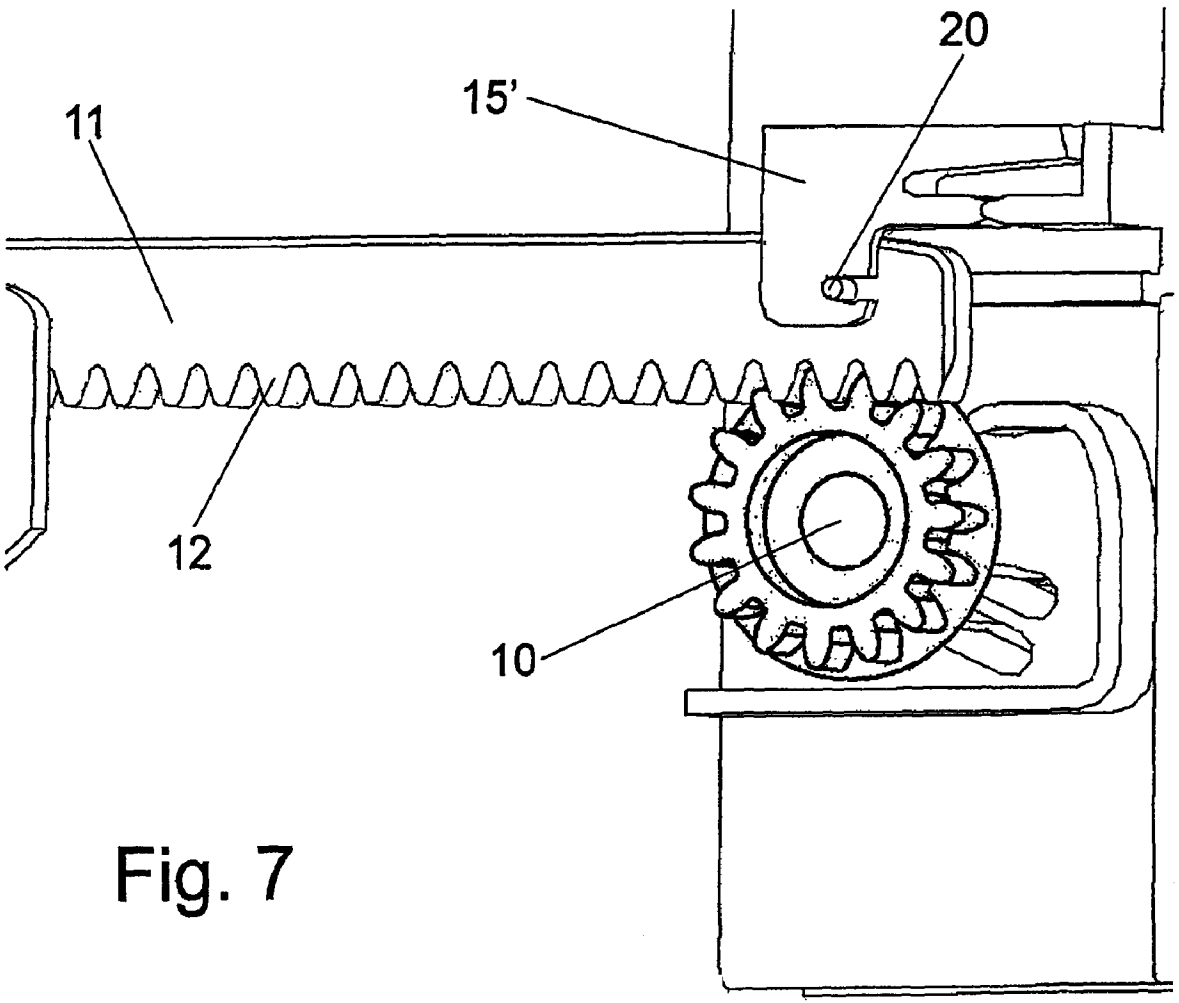
FIG. 7 shows a view, in detail form, of the drawer of FIG. 5 just prior to the end position being reached.

FIG. 7 shows a position in which the drawer 1 is arranged just prior to the end position and the gearwheel 10 meshes with the rack 12 at an end region of the lever 11. The driver or peg 20 has been introduced into the holder 21 in the sliding element 151.

Figure 8:
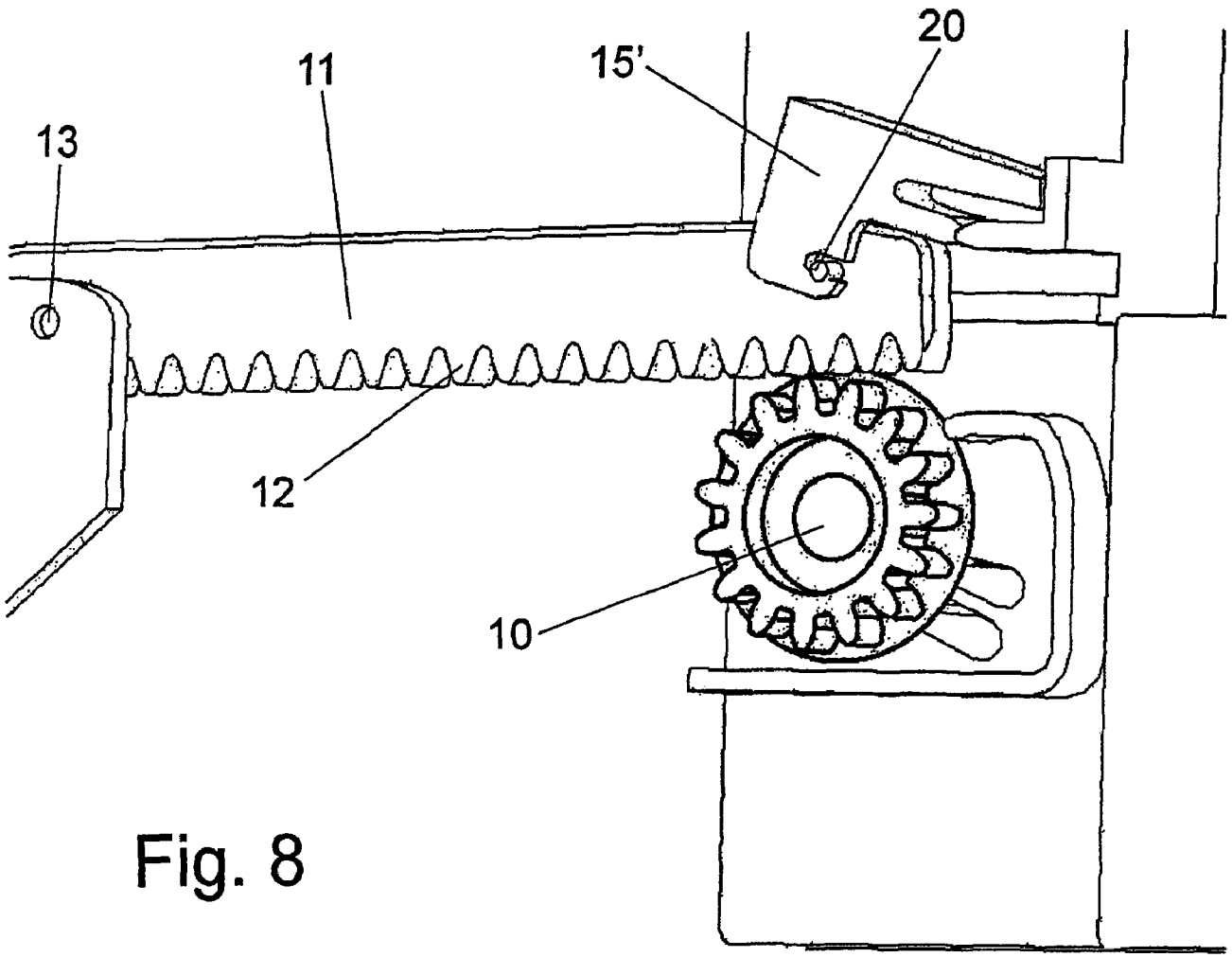
FIG. 8 shows a view, in detail form, of the drawer from FIG. 5 in the correction position.

If the drawer 1 is moved just slightly further out of the basic furniture structure, a position which is illustrated in FIG. 8 is reached. The horizontal movement of the driver 20 has then pivoted the sliding element 151, as a result of which the holder 21 likewise pivots the driver 20 upward and raises the lever 11 up from the gearwheel 10. It is thus possible for the gearwheel 10 to be moved freely relative to the rack 12 and for positioning to be corrected.

For the purpose of disengaging the engagement between the lever 11 and the gearwheel 10, it is also possible to use other mechanical means which are actuated either manually or automatically. Corresponding sliding elements 15 may be pivotable or displaceable, and it may also be possible to provide, in addition, other coupling means or compensating means.

Although the present invention has been described and illustrated in detail, it is to be clearly understood that the same is by way of illustration and example only, and is not to be taken by way of limitation. The scope of the present invention are to be limited only by the terms of the appended claims.

The invention claimed is:

1. A drawer which can be displaced relative to a basic furniture structure, via a pull-out guide, from a position within the basic furniture structure into a pulled-out position in front of the basic furniture structure, and the drawer has, on the opposite sides, at least one gearwheel which meshes with a rack, secured on the basic furniture structure, a pivotal lever extends the length of the rack, in order to ensure that the drawer is also guided by the gearwheels to the pulled-out position, and including means for permitting the pivotable lever to be disengaged from the meshing gearwheel and the pivotal levers in the pulled-out position to correct skewed positioning of the drawer.

2. The drawer as claimed in claim 1, wherein the lever, in a correction position, can be raised up from the gearwheel.

3. The drawer as claimed in claim 1 wherein the lever is guided between the gearwheel and a sliding element to maintain the lever on the gear wheel, and the means allows the sliding element to be moved away from the lever in a correction position of the drawer.

4. The drawer as claimed in claim 3, wherein the sliding element is a lever element which can be pivoted manually away from the lever in order for the lever to be disengaged from the gearwheel if required.

5. The drawer as claimed in claim 3, wherein the means include a driver on the lever which acts on the slide element to automatically raise the lever in the correction position.

6. The drawer as claimed in claim 1, wherein the lever includes a driver, on which the means acts for raising the lever from the gearwheel.

7. The drawer as claimed in claim 1 wherein, by virtue of the drawer being moved into a correction position, the means raises the lever automatically from the gearwheel.

8. The drawer as claimed in claim 2 wherein, the correction position is the position in which the drawer has been pulled out to the full extent.

9. The drawer as claimed in claim 1 wherein, when the meshing gearwheel is moved into the basic furniture structure, the lever pivots downward into the basic furniture structure.

10. The drawer as claimed in claim 5 wherein the driver is a pin which engages a slot on the lever element to rotate the lever element and raise the lever with movement of the drawer to the correction position.

* * * * *